US005572228A

United States Patent [19]

Manasson et al.

[11] Patent Number: 5,572,228

[45] Date of Patent: Nov. 5, 1996

[54] EVANESCENT COUPLING ANTENNA AND METHOD FOR THE UTILIZATION THEREOF

[75] Inventors: Vladimir A. Manasson; Lev S. Sadovnik, both of Los Angeles; Paul I. Shnitser, Irvine, all of Calif.

[73] Assignee: Physical Optics Corporation, Torrance, Calif.

[21] Appl. No.: 382,493

[22] Filed: Feb. 1, 1995

[51] Int. Cl.[6] ..... H01Q 13/00

[52] U.S. Cl. ..... 343/785; 343/781 R; 343/781 P; 333/248

[58] Field of Search ..... 343/785, 772, 343/776, 781 R, 781 P, 782, 783; 333/248, 239; H01Q 13/00

[56] References Cited

U.S. PATENT DOCUMENTS

| | | | |
|---|---|---|---|
| 2,993,205 | 7/1961 | Cooper | 343/785 |
| 5,014,069 | 5/1991 | Seiler et al. | 343/785 |
| 5,015,052 | 5/1991 | Ridgway et al. | 350/96.13 |
| 5,305,123 | 4/1994 | Sadovnik et al. | 359/4 |

FOREIGN PATENT DOCUMENTS

| | | | |
|---|---|---|---|
| 741911 | 12/1955 | United Kingdom | 343/727 |
| WO87/01243 | 2/1987 | WIPO . | |

OTHER PUBLICATIONS

"Radiation Characteristics of a Dielectric Slab Waveguide Periodically Loaded with Thick Metal Strips," Matsumoto et al., *IEEE Transactions on Microwave Theory and Techniques,* vol. MTT-35, No. 2, Feb. 1987, pp. 89–95.

"A Practical Theory For Dielectric Image Guide Leaky-Wave Antennas Loaded By Periodic Metal Strips," Guglielmi et al., *Polytechnic University,* Brooklyn New York, U.S.A., pp. 549–554.

"Antenna Technology for Millimeter-Wave Applications in Automobiles," Jain, Hughes.

"MM-wave Radar for Advanced Intelligent Cruise Control Applications," Tribe et al., *John Langley Lucas Industries, plc, UK,* pp. 9, 10 (M1.1) & 18 (M1.4).

"Millimeter-Wave Beam Steering Using 'Diffraction Electronics,'" Seiler et al., *IEEE Transactions on Antennas and Propagation,* vol. AP-32, No. 9, Sep. 1984, pp. 987–990.

WFFB "Millimeter-Wave Technology Application in Automobiles," 1994 *IEEE MTT-S International Microwave Symposium,* May 23–27, 1994, San Diego, CA, Workshop Notes.

An Automotive Collision Avoidance and Obstacle Detection Radar Battelle, Columbus Div. May 1, 1986, pp. 1–14.

Millimeter-Wave Beam Steering Using "Diffraction Electronics", M. Seiler & B. Mathena, IEEE Transactions on Antennas and Propagation, vol. AP-32, No. 9, Sep. 1984.

Russian Publication 1978, Tom 240, No. 6, pp. 1340–1343, Andrenko et al.

Russian Publication 1979, Tom 247, No. 1, pp. 73–76, Andrenko et al.

*Primary Examiner*—Hoanganh Le
*Attorney, Agent, or Firm*—Nilles & Nilles, S.C.

[57] ABSTRACT

A scanning antenna is disclosed including: a rotatable cylinder having an outer surface; a varying period conductive grating pattern of separated strips on the outer surface, the varying conductive grating pattern of separated strips defining a grating axis; and a first elongated dielectric waveguide defining a first waveguide axis, the first elongated dielectric waveguide being located proximally adjacent and alongside the varying conductive grating pattern of separated strips so as to evanescently couple electromagnetic signals with the first elongated dielectric waveguide. The scanning antenna provides advantages in that the gain is high.

14 Claims, 4 Drawing Sheets

EVANESCENT COUPLING ANTENNA AND METHOD FOR THE UTILIZATION THEREOF

BACKGROUND OF THE INVENTION

1. Field of Use

The present invention relates generally to the field of antennas. More particularly, the present invention concerns evanescent coupling antennas. Specifically, a preferred embodiment of the present invention is directed to an evanescent coupling scanning antenna. The present invention thus relates to antennas of the type that can be termed evanescent coupling scanning antennas.

2. Description of Related Art

Within this application several publications are referenced by arabic numerals within parentheses. Full citations for these, and other, publications may be found at the end of the specification immediately preceding the claims. The disclosures of all these publications in their entireties are hereby expressly incorporated by reference into the present application for the purposes of indicating the background of the invention and illustrating the state of the art.

Vehicle collisions represent a significant public health hazard as well as a cause of significant economic loss each year. Therefore, there has been a long felt need for an inexpensive collision avoidance system for use in aircraft, automobiles and other vehicles.

Recently[1], the National Highway Traffic Safety Administration (NHTSA) identified autonomous intelligent cruise control (AICC) and similar autonomous collision avoidance systems (CAS) as precursors to fully automated driving in the proposed future Automated Highway System. The spring 1994 issue of IVHS Review[2] indicates that the significance of highway safety as a public health hazard is greatly underestimated. Highway collisions are the sixth leading cause of death in the USA, and the major cause of death for people below the age of 25. A recent NHTSA report gives the costs associated with the 44,531 deaths, 5.4 million injuries, and 28 million damaged vehicles in 1990; the losses are estimated to be $137.5 billion in lost wages and other direct costs. The economic loss from traffic collisions represents greater than 2% of the U.S. GNP, and results in nearly 2 billion hours of lost time and 7.5 million liters of wasted fuel each year.

Collision avoidance systems for highway vehicles are designed to be a countermeasure to one or more classes of recognized collision types. Collision avoidance systems for highway vehicles are generally grouped into three categories: near obstacle detection systems (NODs), forward looking (FLR) systems, and wide angle imaging systems for all weather and night vision (AWNV).

The clear choice of wavelength for FLR and AWNV sensors is the millimeter wavelength (MMW) range. The European frequency allocation is 76 to 77 GHz. The Japanese frequency allocation is currently 59 to 60 Ghz, and the U.S. allocation, while still under discussion, has tended to be around 76 to 77 GHz, although 94 GHz is also discussed. The electronic and signal processing parts of FLR and AWNV systems are considered to be essentially developed and ready for mass production.

Millimeter wavelength transceiver electronic packages for use in conjunction with vehicle collision avoidance systems for vehicles such as, for example aircraft, are already commercially available. An example of such a commercially available transceiver electronic package is Litton's millimeter wavelength transceiver.[4]

However, an inexpensive scannable millimeter wavelength antenna is not yet commercially available for use with such collision avoidance systems. As a practical economic matter, the phase shifting element solution used for prior art seeker applications cannot be adopted for use in a commercial vehicle collision avoidance system because of the extremely high cost of the individual phase shifting elements that are a part of such seeker applications, (i.e., from approximately $2,000 to approximately $10,000). Further, the phase shifting element solution used for prior art seeker applications cannot be adopted for use in a commercial vehicle collision avoidance system because of the very high cost of the skilled hand labor required for the assembly of such a phased array antenna.

An IEEE workshop in May 1994[3] on millimeter wavelength technology for automobiles identified the millimeter wavelength scanning antenna as a key element needed to complete an economically feasible automobile collision avoidance system for automobiles. However, of more than 30 existing antenna technologies previously studied, none satisfies the full range of required parameters for such a millimeter wavelength scanning antenna, especially the possibility of being mass produced at very low cost.

A millimeter wavelength scanning antenna that is economically feasible for use in automobiles would probably be feasible for use in more expensive vehicles such as, for example, aircraft. A commonly accepted cost of an economically feasible forward looking millimeter wavelength antenna for an automobile is approximately $50. Clearly, the existing antennas that are widely used for prior art seeker applications cannot be manufactured at such a low cost. Therefore, there has been a long felt need for a low cost millimeter wavelength scanning antenna.

The availability of a low cost millimeter wavelength scanning antenna would make an inexpensive vehicle collision avoidance system a commercial reality. Such a low cost millimeter wavelength scanning antenna could be used to provide an inexpensive collision avoidance system for aircraft, automobiles or other types of vehicles.

The below-referenced U.S. patent discloses embodiments that are satisfactory for the purposes for which they were intended but which have certain disadvantages. The disclosure of the below-referenced prior United States patent in its entirety is hereby expressly incorporated by reference into the present application.

U.S. Pat. No. 5,305,123 discloses a light controlled spatial and angular electromagnetic wave modulator. In embodiments disclosed in the above-referenced prior patent, periodic perturbations of the complex dielectric field in the surface of the semiconductor material induced by an optical control pattern cause electromagnetic waves to be coupled out-of a semiconductive material in a particular direction depending upon the period of the perturbations. Further, rapid variations in the period of the perturbations can be induced by controlling the optical control pattern. Furthermore, rapidly changing the period of the perturbations, (i.e., the grating period induced by the optical control pattern), can be used to control the direction of beam scanning and beam steering.

A disadvantage of embodiments disclosed in the above-referenced prior patent is that the millimeter wavelength energy propagates though the control pattern reactive semiconductive plate. Another disadvantage of preferred embodiments disclosed in the above-referenced prior patent is that a separate optical control pattern is directed onto the semiconductive plate to steer the beam with the attendant complexity and cost associated with generating and directing such an optical control pattern.

SUMMARY OF THE INVENTION

It is therefore an object of the present invention to provide a scanning antenna comprising a rotatable cylinder having an outer surface; a varying conductive grating pattern on said outer surface, said varying conductive grating pattern defining a grating axis; and a first elongated dielectric waveguide defining a first waveguide axis, said first elongated dielectric waveguide being connected to and located proximally adjacent and alongside said varying conductive grating so as to evanescently couple electromagnetic signals with said first elongated dielectric waveguide.

In accordance with this aspect of the present invention, a scanning antenna is provided comprising a frame; an electric motor connected to said frame; a spindle connected to said electric motor; a rotatable cylinder connected to said spindle, said rotatable cylinder having an outer surface; a varying conductive grating pattern on said outer surface, said varying conductive grating pattern defining a grating axis; a first elongated dielectric waveguide defining a first waveguide axis, said first elongated dielectric waveguide being connected to said frame and located proximally adjacent and alongside said varying conductive grating so as to evanescently couple electromagnetic signals out-of said first elongated dielectric waveguide; an electromagnetic signal source connected to said first elongated dielectric waveguide; a second elongated dielectric waveguide defining a second waveguide axis, said second elongated dielectric waveguide being connected to said frame and located proximally adjacent and alongside said varying conductive grating so as to evanescently couple electromagnetic signals into said second elongated dielectric waveguide; and an electromagnetic signal receiver connected to said second elongated dielectric waveguide.

In accordance with this aspect of the present invention, a method is provided comprising providing a rotatable cylinder having an outer surface; providing a varying conductive grating pattern on said outer surface, said varying conductive grating pattern defining a grating axis; providing a first elongated dielectric waveguide defining a first waveguide axis, said first elongated dielectric waveguide being connected to and located proximally adjacent and alongside said varying conductive grating so as to evanescently couple electromagnetic with said first elongated dielectric waveguide; coupling electromagnetic signals with said first elongated dielectric waveguide by evanescent coupling; and rotating said varying conductive grating so as to scan said scanning antenna.

A principle object of the present invention is to provide a guided wave antenna with a high gain.

Another object of the present invention is to provide a scanning antenna with a high scanning rate.

A further object of the present invention is to provide a scanning antenna that is inexpensive to fabricate.

It is still another object of the present invention to provide a scanning antenna with a well defined beam pattern.

Other aspects and objects of the present invention will be better appreciated and understood when considered in conjunction with the following description and drawing sheets.

BRIEF DESCRIPTION OF THE DRAWINGS

The advantages and features of the present invention will become more readily apparent with reference to the detailed description which follows and to exemplary, and therefore non-limiting, embodiments illustrated in the following drawings in which like reference numerals refer to like elements and in which.

DESCRIPTION OF THE PREFERRED EMBODIMENTS

Figure 1:
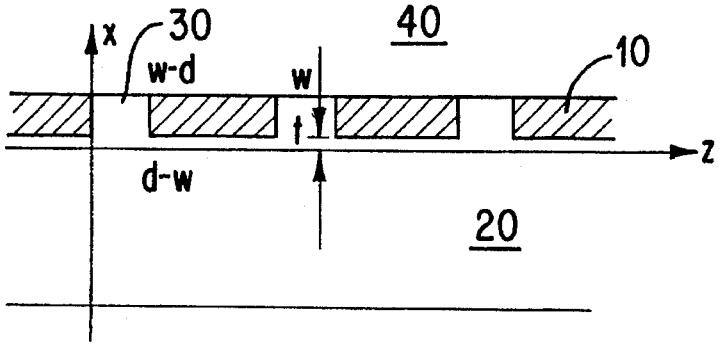
FIG. 1 illustrates a schematic view of evanescent wave coupling according to the present invention.

The present invention and various aspects, objects, advantages, features and advantageous details thereof are explained more fully below with reference to exemplary, and therefore non-limiting, embodiments described in detail in the following disclosure and with the aid of the drawings. In each of the drawings, pans the same as, similar to, or equivalent to each other, are referenced correspondingly.

1. Resume

All the disclosed embodiments can be realized using conventional materials, components and procedures without undue experimentation. All the disclosed embodiments are useful in conjunction with antenna systems such as are used for the purpose of transmitting and/or receiving electromagnetic signals, such as, for example, millimeter wavelength signals, for the purpose of, for example, providing an inexpensive aircraft or automobile collision avoidance system, or the like.

2. System Overview

In the present invention, electromagnetic waves are evanescently coupled into and/or out-of a waveguide in a guided direction that is a function of the period of perturbations in the complex dielectric field on or near the surface of the waveguide. Further, the guided direction can be varied in response to changes in the periodicity of the perturbations. A guided wave antenna in accordance with the present invention is thereby provided with the ability to scan.

Referring to the drawings, it can be seen that the present invention can use inexpensive components. Pursuant to the present invention, preferred embodiments can also have a low manufacturing cost because fine tuning of the guided wave antenna is not necessarily required.

3. Detailed Description of a Preferred Embodiment

As illustrated in Table I (set forth below), a millimeter wavelength transceiver antenna for an aircraft landing system should advantageously meet various performance characteristics.

TABLE I

Advantageous Performance Characteristics

| PARAMETER | SPECIFICATION |
|---|---|
| Center Frequency | 94.3GHz |
| Bandwidth | 400 MHz |
| Gain | 39 dB |
| Horizontal Beamwidth | 0.36° |
| Vertical Beamwidth | 4°, Shaped |
| Polarization | Vertical |
| Sidelobes | |
| First | −15 dB |
| >5 | −30 dB |
| SWR | <1.5:1 |
| Scan | ±30° |
| Azimuth Scan | Linear |
| Elevation Adjustment | ±15° |
| Elevation Rate | ±15°/sec |
| Azimuth Alignment | 0.1°deg |
| Elevation Alignment | 0.3°deg |
| Scan Rate | 10 Hz |
| Antenna Port | WR10 |
| Sync Signal | Provided |
| Antenna Dimensions | 24 in. × 12 in. × 12 in. |

It can be seen from Table I that a millimeter wavelength transceiver antenna for an aircraft collision avoidance system requires high performance in a compact package.

In accordance with the present invention, an evanescent coupling scanning antenna can be provided that utilizes the coupling of electromagnetic waves in and out-of a dielectric waveguide. In accordance with a preferred embodiment of the present invention, electromagnetic waves are evanescently coupled into and/or out-of a dielectric waveguide by bringing an electrically conductive metallic grating pattern into close proximity with the dielectric waveguide. Rapid changes of the grating period, which can be obtained by rotating a drum on which a continuously, steppingly or digitally variable conductive grating pattern has been formed, provides a guided-wave antenna in accordance with this preferred embodiment of the invention that has the ability to scan.

Referring to FIG. 1, an evanescent coupling scanning antenna in accordance with the present invention can be assembled by providing by a metallic structure 10, which is placed in a region that is close to a dielectric waveguide 20, so that an evanescent wave propagates. Periodic perturbations close to the dielectric waveguide 20, cause electromagnetic waves, for example millimeter wavelength waves, to couple with (i.e., into or out-of) the waveguide.

The integral boundary equations for the unknown $E_y$ field can be solved in this geometry for a region filled with a medium 30, whose dielectric X, is $\epsilon_m$. The contour integral will be replaced with a sum by using step functions with constant values over each segment of the contour. The Bessel function of the second kind and zeroth order, $N_o(.)$ can be used as the Green's function.[8]

$$\psi(r,r_o) = -\frac{1}{4} N_o\left(\frac{2\pi}{\lambda}\epsilon_m^{1/2}|r-r_o|\right), \quad \text{Eq. (1)}$$

where $r_o$ is the midpoint of each segment. The solution will yield the optimal geometrical distance t from the grating (which can be moving, for example, rotating) to the dielectric waveguide, the filling medium dielectric permittivity $\epsilon_m$, (starting from the air 40, $\epsilon$=1) and the grating duty cycle ratio w-d/w required to maximize the coupling efficiency.

Figure 2A:
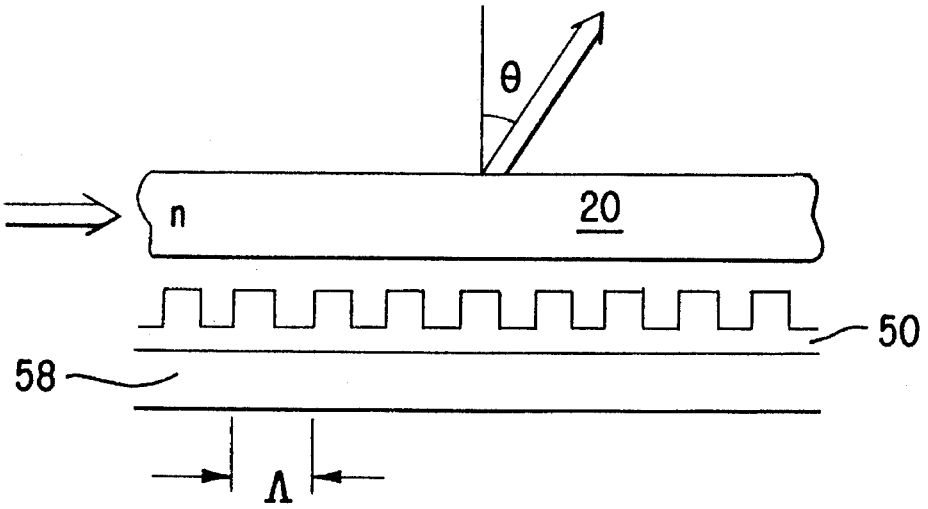
FIG. 2A illustrates a schematic view of an evanescent wave coupling out-of a dielectric waveguide according to the present invention.

Referring now to FIG. 2A, if a periodic metallic structure 50, with a period Λ, is brought into close proximity with a dielectric waveguide 20, coupling of electromagnetic waves, for example coupling of millimeter wavelength signals, occurs in a direction described by:

$$\sin\theta = \left(\frac{\lambda_g}{\lambda_o} - n\frac{\lambda_o}{\Lambda}\right), \quad \text{Eq. (2)}$$

where $\lambda_o$ and $\lambda_g$ are the wavelengths in free space and in a dielectric waveguide with a refractive index n, respectively.

As a result, electromagnetic energy, for example millimeter wavelength signals, will be evanescently coupled with the waveguide 20, in a controlled direction. In FIG. 2A, coupling of waves out-of the dielectric waveguide 20, is shown. This direction can be changed rapidly, by changing the period Λ, to scan the antenna beam. In this transmitting mode, the outgoing millimeter wavelength signals will be preferentially evanescently coupled out-of the waveguide toward a particular direction.

Substrate 58, can be any material that is suitable for supporting metal structure 50, such as, for example, plastic, metal, glass or ceramic. Substrate 58, is preferably provided as a rotatable cylinder so that metal structure 50 can define a varying conductive grating pattern on the rotatable cylinder.

Figure 2B:
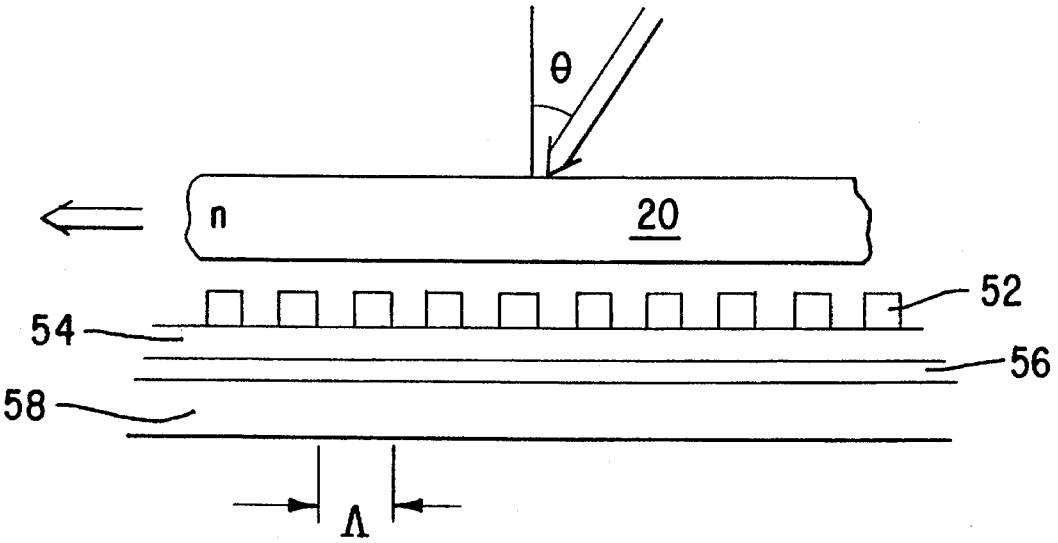
FIG. 2B illustrates a schematic view of an evanescent wave coupling into a dielectric waveguide according to the present invention.

Referring now to FIG. 2B, if a periodic metal grating 52, with a period Λ, is brought into close proximity with a dielectric waveguide 20, coupling of electromagnetic waves, for example coupling of millimeter wavelength signals, into the dielectric waveguide 20, also occurs. In the particular embodiment shown in FIG. 2B, periodic metal grating 52 is formed on insulator layer 54. Insulator layer 54 is formed on metal shield layer 56. Similarly, metal shield layer 56 is formed on substrate 58. Substrate 58, is preferably provided in the shape of a rotatable cylinder so that metal grating 52, insulator layer 54 and metal shield layer 56 all coaxial. In this receiving mode, the incoming millimeter wavelength signals will be preferentially evanescently coupled into the waveguide from a particular direction.

Figure 3:
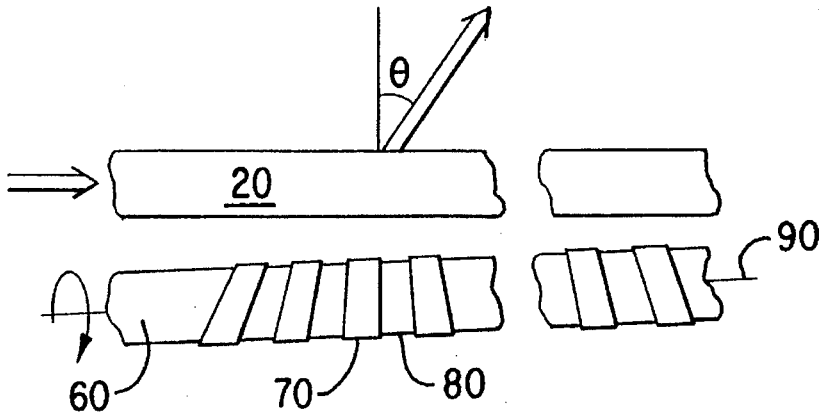
FIG. 3 illustrates a schematic view of an embodiment of a scanning antenna according to the present invention.

Referring now to FIG. 3, an evanescent coupling scanning antenna in accordance with the present invention can be implemented using a dielectric waveguide 20, and cylinder 60. The cylinder 60, is provided with a conductive structure 70, on the outer surface 80, of the cylinder 60. The conductive structure 70 can be a conductive grating. In FIG. 3, coupling of waves out-of the dielectric waveguide 20, is shown.

The conductive structure 70, can be provided on the outer surface 80, of the cylinder 60, in any manner that is functionally consistent with the operation of the antenna. For example, the conductive structure 70, can be provided by first coating the outer surface 80, of the cylinder 60, with a metal film, such as, for example, one or more metals selected from the group consisting of silver, copper and aluminum, and then etching the metal film to form a conductive grating. As additional examples, the conductive structure 70, can be provided by laminating or transferring a subassembly that includes a metal grating onto the outer surface 80, of the cylinder 60. Of course, there can be other layers on cylinder 60, such as, for example, insulative layers and metallic shielding layers.

The cylinder 60, rotates with the passage of time so that different portions of the conductive structure 70, are in close proximity to the waveguide 20. The conductive structure 70, is preferably a conductive grating having a varying periodicity. The varying period of such a grating provides the capability of scanning the beam. The varying period of such a grating is a junction of an angle defined by a position of the rotatable cylinder. In order to compensate for the depletion of the traveling wave in the waveguide 20, the cylinder's axis 90, can be slightly titled relative to the waveguide's axis. Further, the grating period can be slightly changed to compensate for changes in $\lambda_g$ caused by the tilting of the cylinder's axis 90.

Still referring to FIG. 3, the conductive structure 70, can be a continuously varying conductive grating pattern on the outer surface of the rotatable cylinder. Continuous varying of the grating period provides the capability of continuous scanning of the millimeter wavelength beam. This scanning of the millimeter wavelength beam can be termed analog scanning, because at any instant of time, a grating with a certain period can be in close proximity to the waveguide.

Figure 4:
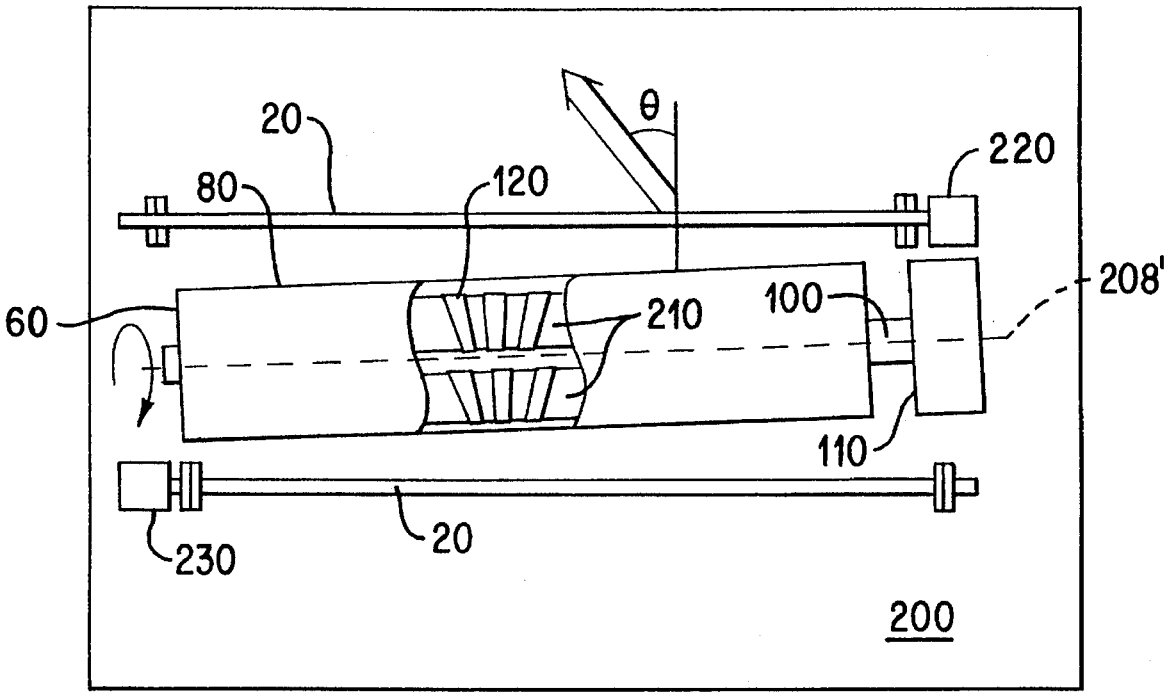
FIG. 4 illustrates a schematic view of another embodiment of a scanning antenna according to the present invention.

Referring now to FIG. 4, cylinder 60, is mounted on a spindle 100, that is connected to frame 200 and rotated by an electric motor 110 around grating axis 208. In order to synchronize the transmitter/receiver operations, a preferred embodiment of the present invention utilizes two waveguides 20, and a single motor driven cylinder 60, with a steppingly varying conductive grating pattern on the outer surface of the rotatable cylinder.

One of the waveguides 20 is connected to source 220. The other of the waveguides is connected to receiver 230.

As shown schematically, through a quasi-penetrating view in the center of the cylinder 50, the conductive grating pattern structure on the rotatable cylinder's surface can be a radially disposed series of continuously variable gratings that together define a series of scanning steps. As immediately described above, each of the series of steps can include a plurality of slanted metal strips 120, that cover a portion of the outer surface 80, of the cylinder 60, so that the grating period varies continuously within each step. Preferably, the series of steps is a repeating sequence of steps that is radially disposed so as to define a radial periodicity that is independent from the periodicity defined by the variable scalar distance between the slanted metal strips themselves. As the cylinder 60 rotates, at a subsequent instant in time, a portion of a given grating with a different period can be in proximity to the waveguide 20. The grating pattern of each step can be designed to couple the millimeter wavelength energy into and/or out-of the waveguide 20 and to scan an appropriate beam pattern. Such a combination of slanted metal strips 120, is a steppingly varying conductive grating pattern on the outer surface of cylinder 60. Further, the sequence of steps can be designed to scan a lower frequency macro beam pattern that includes a plurality of micro beam patterns each of which is scanned by one of the individual steps.

Figure 5:
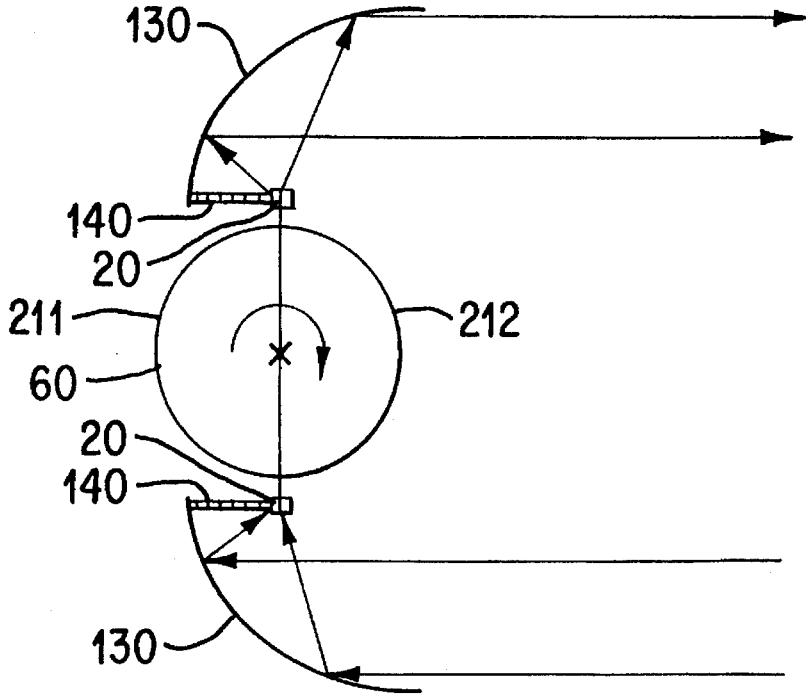
FIG. 5 illustrates a schematic cross-sectional view of the embodiment of a scanning antenna embodiment according to the present invention shown in FIG. 4.

Moreover, for ease of manufacture, cylinder 60, can be provided by assembling a set of several sectors 210, such as, for example, two semicylinders 211 and 212 as shown in FIG. 5. In a preferred embodiment, the slanted metal strips 120, are formed on the corresponding outer surfaces of two semicylinders before the semicylinders are assembled into the single cylindrical drum. Each of the set of several sectors can be a cylindrical section that is provided with a subassembly structure that defines one of a series of steps. As noted above, continuous varying of the grating period within each step provides the capability of continuous scanning of the millimeter wavelength beam during each step. Such a series of steps permits steppingly varying scanning. As a first step routes away from a waveguide, a second step rotates toward the waveguide and an identical, or different, scanning pattern can be repeated.

Significantly, the grating pattern on the cylinder can be designed so that at any instant the two gratings facing the two waveguides have the same period. This ensures the same direction for the beams of both transmitted and received millimeter wavelength signals. This scanning of the millimeter wavelength beam can be termed step scanning, because at any instant of time during a given step, a grating with a certain period can be in close proximity to the waveguide.

Referring now to FIG. 5, in the elevation plane, the desired beam width can be achieved through the use of reflectors 130. As shown in FIG. 5, the reflectors 130 are attached to the waveguides 20. Attaching the reflectors 130 to the waveguides 20 provides support to the waveguides 20 and improves the rigidity of the waveguides 20. The waveguide surface facing the attachment 140 can be metalized to form a ground plane. The reflectors 130, can be formed into a parabolic cylinder shape.

Figure 6A:
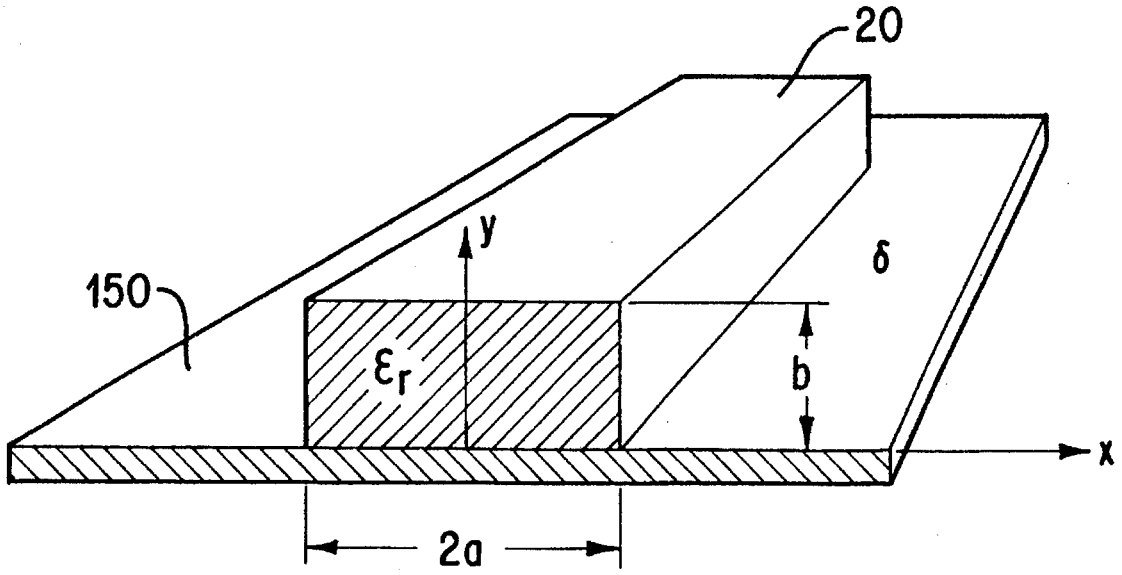
FIG. 6A illustrates a schematic view of the geometry of a ground plane/waveguide interface according to the present invention.

Referring now to FIG. 6A, the geometry of a ground plane 150/waveguide 20, interface is shown. To match the waveguide 20 with a standard WR10 port waveguide 20, dimensions of a=b=1.27 mm can be chosen. As an example, the waveguide material can be quartz with $\epsilon$=3.8. As follows from the dispersion curves for $E^Y_{mm}$ modes in an image line, [10] for the above parameters there exists only one vertically polarized propagation mode $E^Y_{11}$ at $\lambda_0$=3.18 mm, for which $\lambda_0/\lambda_g$=1.39. As further examples, the waveguide material can include one or more of silica, sapphire, silicon, gallium arsenide, non-fluorinated polyethylenes and fluorinated polyethylenes, such as, for example, TEFLON and DUROID.

Figure 6B:
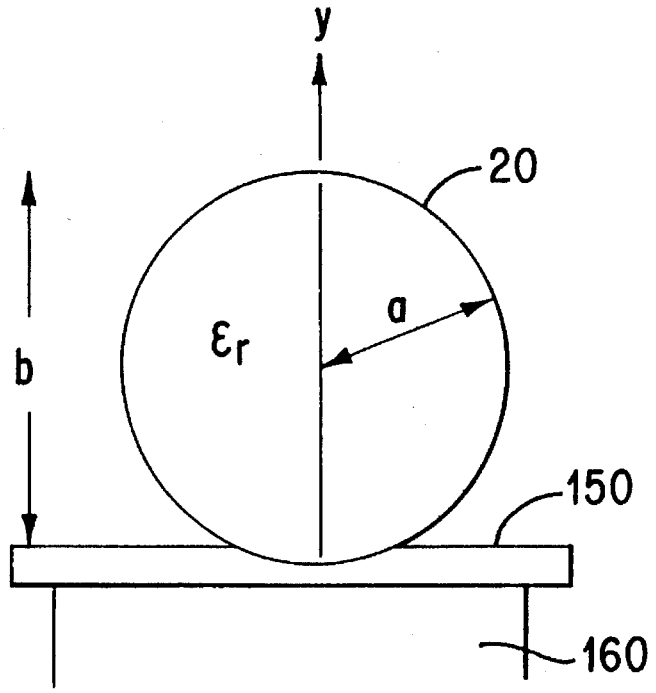
FIG. 6B illustrates a schematic view of the geometry of another ground plane/waveguide interface according to the present invention.

Referring to FIG. 6B, a schematic view of the geometry of a preferred ground plane/waveguide interface according to the present invention is shown. In this embodiment, a waveguide 20, is in the form of a cylinder and is attached to ground plane 150. Ground plane 150, is attached to support 160. The radius of the waveguide 20, can be, for example, 0.50 mm. The ground plane 150, can be a metalization layer that includes a metal, such as, for example, one or more of silver, copper and aluminum, as a shielding material. Because of its high conductivity, the shielding material will effectively reflect millimeter wavelength signals, acting as a metal ground plate.

Figure 7:
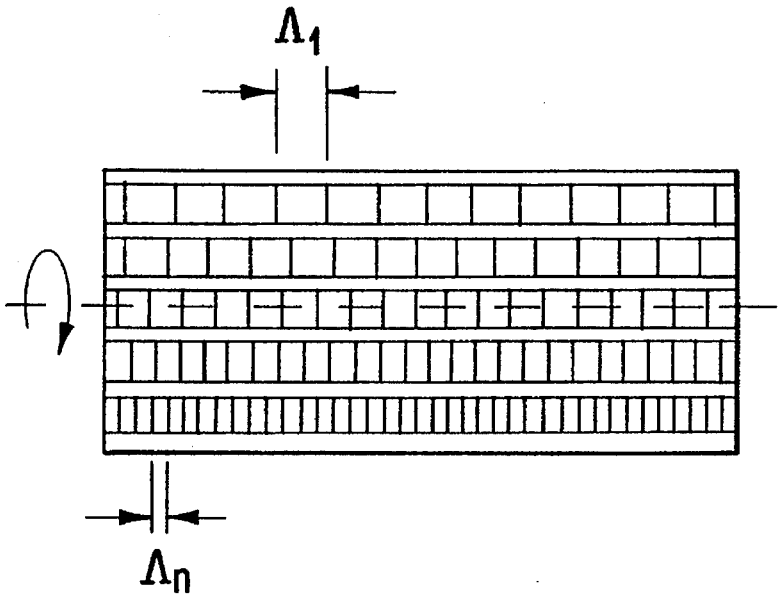
FIG. 7 illustrates a schematic view of a digitally varying conductive grating according to the present invention.

Referring to FIG. 7, a schematic view of another conductive grating according to the present invention is shown. The conductive structure is a digitally varying conductive grating pattern on the outer surface of the rotatable cylinder. The conductive structure permits digital scanning because it is a series of steppingly changed gratings. A digially varying conductive grating pattern can be used as one or more steps in a steppingly varying conductive grating pattern.

The development of an evanescent coupling scanning antenna in accordance with the present invention can benefit collision avoidance systems by offering a lightweight, inexpensive scanning antenna. Such a scanning antenna can be manufactured using standard semiconductor processing technology without the need for hand fabrication or adjustment.

The development of an evanescent coupling scanning antenna in accordance with the present invention can benefit collision avoidance systems by avoiding high density packaging problems. For example, such a scanning antenna would not need to have phase shifters.

The development of an evanescent coupling scanning antenna in accordance with the present invention can benefit collision avoidance systems by providing operation over the full W-band (60 to 140 GHz) with linear performance. This may improve frequency modulated carrier wave (FMCW) Doppler ranging. A discrete element array would require higher emitter packaging density with increased frequency.

The development of an evanescent coupling scanning antenna in accordance with the present invention can benefit collision avoidance systems by providing a wide field-of-view coverage. For example, a field-of-view coverage could be provided of up to approximately ±60° in azimuth.

The development of an evanescent coupling scanning antenna in accordance with the present invention can benefit collision avoidance systems by providing an agile tracking capability. For example, an evanescent coupling antenna according to the present invention can provide an approximately 1 kHz track measurement rate over the entire field-of-view.

The development of an evanescent coupling scanning antenna in accordance with the present invention can benefit collision avoidance systems by providing a very compact antenna design. Such an antenna can also be of low weight.

While not being limited to any particular embodiment, preferred embodiments of the present invention can be identified one at a time by testing for high gain, well defined beam pattern and high scanning rate. The testing for high gain, well defined beam pattern and high scanning rate can be carried out without undue experimentation by the use of the simple and conventional bench top experiments.

The foregoing descriptions of preferred embodiments are provided by way of illustration. Practice of the present invention is not limited thereto and variations therefrom will be readily apparent to those of ordinary skill in the art without deviating from the spirit and scope of the underlying inventive concept. For example, performance might be enhanced by providing large surface area dielectric waveguides. In addition, although silica is preferred for use as the dielectric, any other suitable low load dielectric, such as an alumina, for example sapphire, could be used in its place. Further, although utilization of the present invention for millimeter wavelength signal coupling is preferred, the present invention could be used to couple electromagnetic energy of other frequencies. Finally, the individual components need not be constructed of the disclosed materials or be formed in the disclosed shapes, but could be provided in virtually any configuration which employs periodic perturbations of the complex dielectric advantageous so as to provide coupling.

EXAMPLE

A specific embodiment of the invention will now be further described by the following, non-limiting example which will serve to illustrate various features of significance. The example is intended merely to facilitate an understanding of ways in which the present invention may be practiced and to further enable those of skill in the art to practice the present invention. Accordingly, the example should not be construed as limiting the scope of the present invention.

As illustrated in Table II (set forth below), an especially preferred embodiment of a transceiver antenna for an aircraft landing system, or collision avoidance system, can meet the various advantageous performance characteristics in accordance with the following design parameters.

TABLE II

| Exemplary Design Parameters | |
|---|---|
| Waveguide Dimensions (mm) | 550 × 1.27 × 2.54 |
| Drum Diameter (mm) | 135 |
| Rotation Speed (rpm) | 300 |
| Parabolic Reflector Dimensions (mm) | 550 × 50 |
| Scanning Angle | −49.3° to 10.7° to the normal to the waveguide |
| Grating Period (range, in mm) | 2.65 to 1.48 |
| Antenna Gain (dB) | 39, for 40% coupling efficiency |

It can be seen from Table II that the effect of the present invention is to provide a millimeter wavelength antenna having high performance in a compact package.

Although the best mode contemplated by the inventor of carrying out the invention is disclosed above, many additions and changes to the invention could be made without departing from the spirit and scope of the underlying inventive concept. For example, numerous changes in the details of the parts, the arrangement of the parts and the construction of the combinations will be readily apparent to one of ordinary skill in the art without departing from the spirit and scope of the underlying inventive concept.

Moreover, while there are shown and described herein certain specific combinations embodying the invention for the purpose of clarity of understanding, the specific combinations are to be considered as illustrative in character, it being understood that only preferred embodiments have been shown and described. It will be manifest to those of ordinary skill in the an that certain changes, various modifications and rearrangements of the features may be made without departing from the spirit and scope of the underlying inventive concept and that the present invention is not limited to the particular forms herein shown and described except insofar as indicated by the scope of the appended claims. Expedient embodiments of the present invention are differentiated by the appended subclaims.

The entirety of everything cited above or below is expressly incorporated herein by reference.

REFERENCES

1. W. B. Stevens, W. A. Leasure, and L. Saxton, "The Automated Highway System (AHS) Program, Its Rationale and Its Status," Proc. of the IVHS America 1993, Annual Meeting, p. 54 (1994).
2. G. Parker, "Putting IVHS to Work to Enhance Safety," IVHS Review (Spring 1993).
3. MMW Technology Application for Automobiles Workshop, IEEE MTT-S, International Microwave Symposium, San Diego (May 1994).
4. Litton Solid State, Santa Clara Calif. Commercial Brochure (1994).
5. C. H. Lee, P. S. Mak, and A. P. Defonzo, "Optical Control of Millimeter-Wave Propagation in Dielectric Waveguides," IEEE J. Quantum Electron., vol. QE-16, pp. 277–288 (March, 1980).
6. K. Ogusu, I. Tanka, and H. Itoh, "Propagation Properties of Dielectric Waveguides with Optically Induced Plasma Layers," Trans. IECE Japan, vol. J66-C, pp. 39–46 (January, 1983).
7. M. Matsumoto, M. Tsutsumi, and N. Kunagi, "Bragg Reflection Characteristics of MMW in Periodic Plasma Induced Semiconductor Waveguide," IEEE Transactions on Microwave Theory and Techniques, MIT-34, N4, pp. 406–411 (1986).

8. M. Matsumoto, M. Tsutsumi, and N. Kunnagai, "Radiation Characteristics of Dielectric Slab Waveguide Periodically Loaded with Thick Metal Strips," IEEE Transaction Microwave Theory and Techniques, MTT-35, (2), pp. 89–95 (1987).
9. Hotta, S., M. Kto, and K. Kawoi. "Generation of High Quality Holograms with Liquid Crystal SLM," SPIE Proceedings, Volume 1212, pp. 93–101 (1990).
10. P. Bhartia and I. J. Bahl, Millimeter Wave Engineering and Applications, Wiley, N.Y. 1984.
11. Seiler, Milton R. and Mathena, Bill M., "Millimeter-Wave Beam Steering Using Diffraction Electronics," IEEE Transactions on antennas and Propagation, Vol. AP-32, No. 9, (September 1984).
12. R. Tribe, et al., "MM-wave Radar for advanced intelligent cruise control applications," SPIE Vol. 2250.
13. Jain, Atul, "Antenna Technology for Millimeter-Wave Applications in Automobiles," Hughes Radar Systems, (May 1994).
14. M. Guglielmi and A. A. Oliner, "A Practical Theory for Dielectric Image Guide Leaky-Wave Antennas Loaded by Periodic Metal Strips," pp. 549–552.

What is claimed is:

1. A scanning antenna comprising:

a frame;

an electric motor connected to said frame;

a spindle connected to said electric motor;

a rotatable cylinder connected to said spindle, said rotatable cylinder including an outer surface;

a varying period conductive grating pattern of separates strips on said outer surface, said varying period conductive grating pattern of separated strips defining a grating axis;

a first elongated dielectric waveguide defining a first waveguide axis, said first elongated dielectric waveguide being connected to said frame and located proximally adjacent and alongside said period varying conductive grating pattern of separated strips so as to evanescently couple electromagnetic signals out-of said first elongated dielectric waveguide;

an electromagnetic signal source connected to said first elongated dielectric waveguide;

a second elongated dielectric waveguide defining a second waveguide axis, said second elongated dielectric waveguide being connected to said frame and located proximally adjacent and alongside said varying period conductive grating pattern of separated strips so as to evanescently couple electromagnetic signals into said second elongated dielectric waveguide; and an electromagnetic signal receiver connected to said second elongated dielectric waveguide, wherein a varying period of said varying period conductive grating pattern of separated strips is a function of an angle defined by a position of said rotatable cylinder.

2. The scanning antenna of claim 1 wherein said rotatable cylinder includes two semicylinders.

3. The scanning antenna of claim 1 wherein said varying period conductive grating pattern of separated strips includes a continuously varying period rotatable conductive grating pattern of separated strips.

4. The scanning antenna of claim 1 wherein said varying period conductive grating pattern of separated strips includes a steppingly varying period rotatable conductive grating pattern of separated strips.

5. The scanning antenna of claim 1 wherein said varying period conductive grating pattern of separated strips includes a digitally varying period rotatable conductive grating pattern of separated strips.

6. The scanning antenna of claim 1 wherein said first elongated dielectric waveguide includes at least one material selected from the group consisting of silica, sapphire, silicon, gallium arsenide, non-fluorinated polyethylenes and fluorinated polyethylenes; and said second elongated dielectric waveguide includes at least one material selected from the group consisting of silica, sapphire, silicon, gallium arsenide, non-fluorinated polyethylenes and fluorinated polyethylenes.

7. The scanning antenna of claim 1 further comprising a first elongated reflector defining a first reflector axis, said first elongated reflector being connected to said first elongated dielectric waveguide so that said first reflector axis is substantially parallel to said first waveguide axis so as to reflect electromagnetic signals that are evanescently coupled out-of said first elongated dielectric waveguide; and a second elongated reflector defining a second reflector axis, said second elongated reflector being connected to said second elongated dielectric waveguide so that said second reflector axis is substantially parallel to said second waveguide axis so as to reflect electromagnetic signals that are evanescently coupled into said second elongated dielectric waveguide.

8. The scanning antenna of claim 7 wherein said first elongated reflector is a first elongated parabolic reflector and said second elongated reflector is a second elongated parabolic reflector.

9. The scanning antenna of claim 7 wherein said first elongated reflector is connected to said first elongated dielectric waveguide with a first support that includes a layer containing at least one member selected from the group consisting of silver, copper and aluminum that is adjacent said first elongated dielectric waveguide;

said second elongated reflector is connected to said second elongated dielectric waveguide with a second support that includes a layer containing at least one member selected from the group consisting of silver, copper and aluminum that is adjacent said second elongated dielectric waveguide; and said varying period conductive grating pattern of separated strips includes gold.

10. The scanning antenna of claim 1 wherein said grating axis is nonparallel with both said first waveguide axis and said second waveguide axis.

11. In an aircraft, the improvement comprising the scanning antenna of claim 1.

12. In an automobile, the improvement comprising the scanning antenna of claim 1.

13. A method of operating a scanning antenna comprising:

providing a rotatable cylinder having an outer surface;

providing a varying period conductive grating pattern of separated strips on said outer surface, said varying period conductive grating pattern of separated strips defining a grating axis;

providing a first elongated dielectric waveguide defining a first waveguide axis, said first elongated dielectric waveguide being located proximally adjacent and alongside said varying period conductive grating pattern of separated strips so as to evanescently couple electromagnetic signals with said first elongated dielectric waveguide;

providing a second elongated dielectric waveguide defining a second waveguide axis, said second elongated dielectric waveguide being located proximally adjacent and alongside said varying period conductive grating pattern of separated strips so as to evanescently couple electromagnetic signals into said second elongated dielectric waveguide;

providing an electromagnetic signal receiver connected to said second elongated dielectric waveguide;

providing an electromagnetic signal source connected to said first elongated dielectric waveguide;

coupling electromagnetic signals with said first elongated dielectric waveguide by evanescent coupling;

coupling electromagnetic signals into said second elongated dielectric waveguide by evanescent coupling; and rotating said varying period conductive grating pattern of separated strips so as to scan said scanning antenna, wherein a varying period of said varying period conductive grating pattern of separated strips is a function of an angle defined by a position of said rotatable cylinder and wherein coupling electromagnetic signals with said first elongated dielectric waveguide includes coupling electromagnetic signals out-of said first elongated dielectric waveguide.

14. The method of claim 13 wherein the electromagnetic signals are millimeter wavelength electromagnetic signals.

* * * * *

UNITED STATES PATENT AND TRADEMARK OFFICE

CERTIFICATE OF CORRECTION

PATENT NO. : 5,572,228
DATED : November 5, 1996
INVENTORS : Manasson et al.

It is certified that error appears in the above-identified patent and that said Letters Patent is hereby corrected as shown below:

Column 11, Line 30, delete "separates" and insert --separated--.
Column 11, Line 37, after "said" insert --varying--.
Column 11, Line 37, after "period" delete "varying".

Signed and Sealed this

Third Day of June, 1997

*Attest:*

Bruce Lehman

BRUCE LEHMAN

*Attesting Officer*

*Commissioner of Patents and Trademarks*